US010384828B2

(12) United States Patent
Rajter, Jr. et al.

(10) Patent No.: US 10,384,828 B2
(45) **Date of Patent: *Aug. 20, 2019**

(54) MERCHANDISE STORAGE CONTAINER DEVICE

(71) Applicant: Wynalda Litho, Inc., Belmont, MI (US)

(72) Inventors: Robert G. Rajter, Jr., Rockford, MI (US); Nathanael Albert Wynalda, Belmont, MI (US)

(73) Assignee: Wynalda Litho, Inc., Belmont, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/899,205

(22) Filed: Feb. 19, 2018

(65) Prior Publication Data

US 2018/0215502 A1 Aug. 2, 2018

Related U.S. Application Data

(63) Continuation-in-part of application No. 15/175,669, filed on Jun. 7, 2016, now Pat. No. 9,896,235.

(60) Provisional application No. 62/173,821, filed on Jun. 10, 2015, provisional application No. 62/471,703, filed on Mar. 15, 2017, provisional application No. 62/472,424, filed on Mar. 16, 2017.

(51) Int. Cl.

| | |
|---|---|
| ***B65D 5/42*** | (2006.01) |
| ***B65D 5/64*** | (2006.01) |
| ***B65D 5/68*** | (2006.01) |
| ***B65D 5/50*** | (2006.01) |
| ***B65D 5/44*** | (2006.01) |
| ***B65D 5/22*** | (2006.01) |
| ***B65D 5/38*** | (2006.01) |

(52) U.S. Cl.

CPC ..... *B65D 5/5038* (2013.01); *B65D 5/22* (2013.01); *B65D 5/38* (2013.01); *B65D 5/422* (2013.01); *B65D 5/4229* (2013.01); *B65D 5/4266* (2013.01); *B65D 5/445* (2013.01); *B65D 5/68* (2013.01)

(58) Field of Classification Search

CPC ..... B65D 5/422; B65D 5/64; B65D 5/667; B65D 5/4229; B65D 5/4216; B65D 85/187; B65D 5/685

USPC ..... 229/116.1; 206/268, 831, 459.5

See application file for complete search history.

(56) References Cited

U.S. PATENT DOCUMENTS 502,952 A * 8/1893 Craw ..... B65D 5/68 229/125.19

6,027,018 A 2/2000 Yocum 6,109,514 A 8/2000 Otis (Continued)

OTHER PUBLICATIONS

U.S. Pat. No. 502,952, filed Aug. 1893 Craw.

*Primary Examiner* — Christopher R Demeree

(74) *Attorney, Agent, or Firm* — Zollinger & Burleson Ltd

(57) ABSTRACT

A foldable device for a merchandise storage container includes a promotional panel that has a printable surface disposed on the same side of the blank used to create the device as the other printing surfaces of the device. When the blank is printed, material can be added to the promotional panel at the same time and with the same equipment as the other surfaces of the lid. A reinforcing panel can be attached to the promotional panel to reinforce a lateral wall of the device.

18 Claims, 13 Drawing Sheets

(56) References Cited

U.S. PATENT DOCUMENTS

| | | | | |
|---|---|---|---|---|
| 7,578,428 | B2 * | 8/2009 | Charlton | B65D 33/04 229/110 |
| 8,523,049 | B2 * | 9/2013 | Fitzwater | B65D 5/4204 229/114 |
| 9,174,761 | B1 | 11/2015 | Grist | |
| 9,896,235 | B2 | 2/2018 | Rajter | |
| 2002/0134824 | A1 | 9/2002 | Mills | |
| 2005/0218202 | A1 | 10/2005 | Braoudakis | |
| 2006/0000737 | A1 | 1/2006 | Vogel | |
| 2007/0221518 | A1 * | 9/2007 | Chatelain | B65D 5/422 206/273 |
| 2012/0074823 | A1 | 3/2012 | Bezich | |
| 2012/0118780 | A1 * | 5/2012 | Polloni | B65D 5/16 206/459.5 |
| 2015/0336730 | A1 * | 11/2015 | Shields | B65D 81/18 206/459.5 |

* cited by examiner

MERCHANDISE STORAGE CONTAINER DEVICE

This application claims the benefit of U.S. Provisional Patent application No. 62/471,703 filed Mar. 15, 2017. This application claims the benefit of U.S. Provisional Patent application No. 62/472,424 filed Mar. 16, 2017. This application is a continuation-in-part application claiming priority to application Ser. No. 15/175,669 filed Jun. 7, 2016, which claims the benefit of U.S. Provisional Patent application No. 62/173,821 filed Jun. 10, 2015; the disclosures of each of these applications are incorporated herein by reference.

BACKGROUND OF THE DISCLOSURE

1. Technical Field

The disclosure generally relates to packaging for merchandise and, more particularly, to packaging formed from foldable materials with a printable surface. Specifically, the disclosure relates to a merchandise storage device wherein the interior of a major body panel includes an interior panel that has a printable surface that faces the same direction as the other printable surfaces prior to erection so that the entire device can be printed on one side of the blank.

2. Background Information

Manufacturers seek unique solutions for packaging and displaying their merchandise. One of the many packaging sectors uses fold-up merchandise storage containers erected from flat paperboard blanks. The users of these devices desire these containers to be printed with decorative materials and information about the product to be carried by the container. They also want the containers to be sturdy. One example is a shoe manufacturer which seeks unique packaging alternatives to the standard folded shoebox. One option is to provide printing on the inside surfaces of the shoebox. The printing can be information about the company that manufactured the shoes or it can be a motivational message. Adding such printing to the inside of the box increases printing costs because the printed material is typically added to both sides of the foldable material in order for the printing to appear of the inside of the box. This requires a printer that can print on both sides of the material or a second pass through a printer. Another example of a merchandise storage container is a storage tray that slides into and out of a five-sided sleeve. One type of tray is known as a simplex tray which is in the form of a five-sided tray. The tray can be supplied to the user in a flat configuration and then erected manually or by automated equipment. The trays can be used with lids, sleeves, or a cover. Those who select these slide-out trays for their product desire decorations or printed materials on all exterior surfaces of the tray. Another issue for such trays is the wall that is grasped or pulled on by the end user to pull the tray from the sleeve becomes disfigured.

SUMMARY OF THE DISCLOSURE

The disclosure provides a fold-up merchandise storage container device that can be used alone or as a component of a merchandise storage container assembly. One feature of the device is that it can be provided as a blank that is printed on one side. When the blank is folded into the form of the device, the printing is visible on all of the exterior surfaces of the device.

The disclosure provides an exemplary embodiment in the form of a foldable lid for a box-type container wherein the lid includes a promotional panel that has a printable surface disposed on the same side of the blank used to create the lid as the other printing surfaces of the lid. When the blank is printed, material can be added to the promotional panel at the same time and with the same equipment as the other surfaces of the lid. When the lid is assembled, the promotional panel is disposed on the inside of the main body panel of the lid facing the cavity of the container. When the user removes the lid, the promotional panel can be viewed.

The disclosure also provides a lid for a shoebox type container that has an extra lid panel that provides a finished appearance to the lid and strengthens the lid.

The disclosure provides an exemplary embodiment in the form of a slide-out tray wherein the tray includes a promotional panel that has a printable surface disposed on the same side of the blank used to create the tray as the other printing surfaces of the tray. When the blank is printed, material can be added to the promotional panel at the same time and with the same equipment as the other surfaces of the tray. When the lid is assembled, the promotional panel is disposed on the inside of the main body panel of the tray facing the cavity of the tray that receives the merchandise. When the user removes the merchandise from the tray, the promotional panel can be viewed.

The disclosure also provides a tray configuration wherein a reinforcement panel is provided for the front wall of the tray that is used to pull the tray from the sleeve.

The preceding non-limiting aspects, as well as others, are more particularly described below. A more complete understanding of the processes and equipment can be obtained by reference to the accompanying drawings, which are not intended to indicate relative size and dimensions of the assemblies or components thereof. In those drawings and the description below, like numeric designations refer to components of like function. Specific terms used in that description are intended to refer only to the particular structure of the embodiments selected for illustration in the drawings, and are not intended to define or limit the scope of the disclosure.

BRIEF DESCRIPTION OF THE DRAWINGS

Similar numbers refer to similar parts throughout the specification.

DETAILED DESCRIPTION OF THE DISCLOSURE

Figure 1:
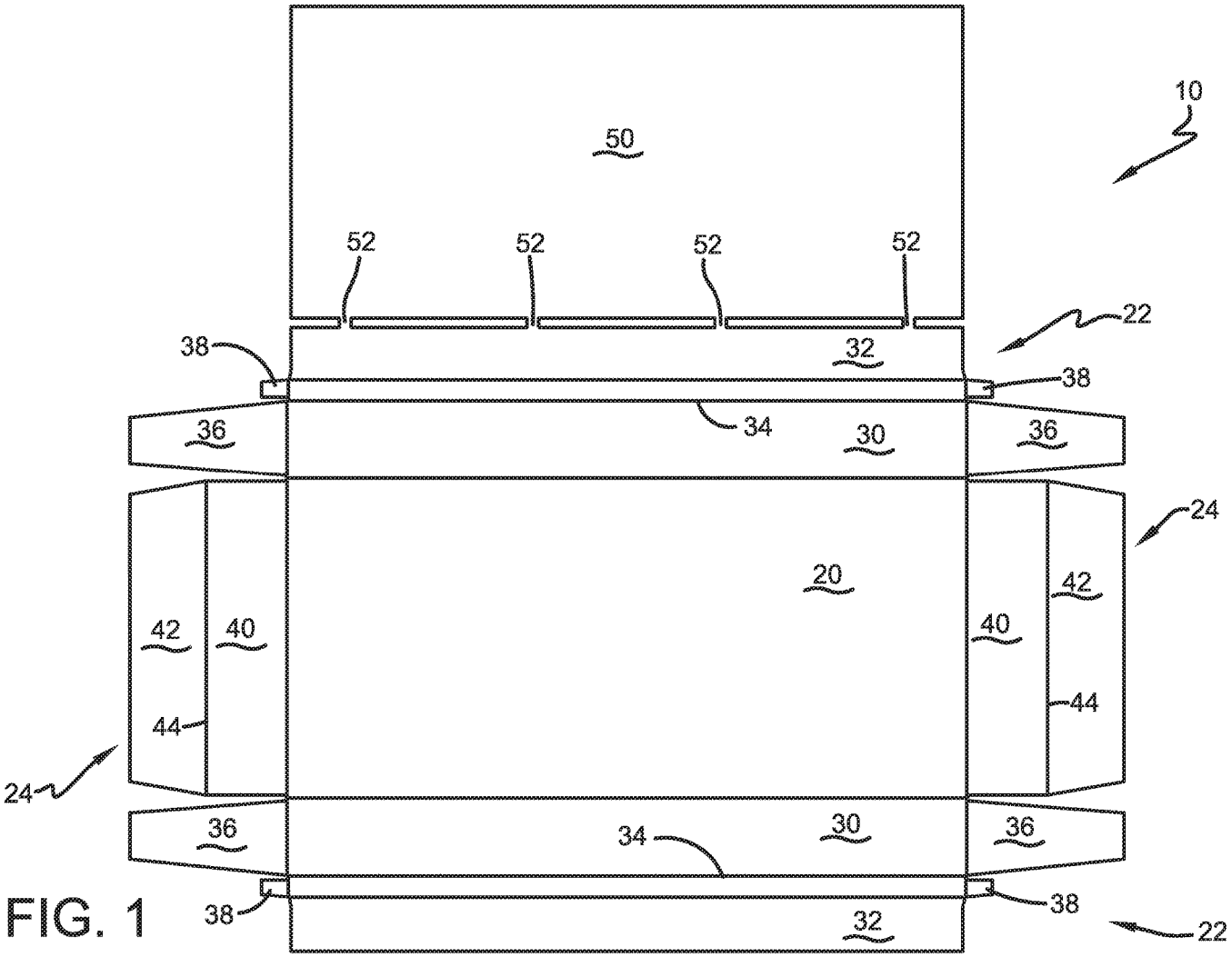
FIG. 1 is a plan view of a blank used to form the exemplary lid of the disclosure.

An exemplary configuration for a box lid is indicated generally by the numeral 10 in the accompanying drawings. Lid 10 can be used with a shoebox-style merchandise container that is typically used for packaging shoes. Lid 10 also may be sized for use with other merchandise packages. Lid 10 is formed from a flat blank of foldable material. The foldable material can be a paper-based material or a polymer. In the exemplary configuration, the foldable material is a 0.024 Solid Bleached Sulphate (SBS) paperboard.

Lid 10 generally includes a main body panel 20, a pair of sidewalls 22, and a pair of end walls 24. Each sidewall 22 is formed from an outer sidewall panel 30 and an inner sidewall panel 32 that is connected to outer sidewall panel 30 with a living hinge or fold 34. When assembled into lid 10, panels 30 and 32 are secured together with glue to form a sidewall of double thickness. Tabs 36 project outwardly from the ends of outer sidewall panel 30. Tabs 36 are folded perpendicular to outer sidewall panel 30 when lid 10 is assembled. Tabs 30 are disposed within end walls 24. Reinforcing tabs 38 project from inner sidewall panels 32 and are folded parallel to tabs 36 and are fit within end walls 24 to strengthen the corners of lid 10. Each end wall 24 includes an outer panel 40 and an inner panel 42 that is connected to outer panel 40 with a living hinge or a fold 44. When assembled into lid 10, panels 40 and 42 are secured together with glue to form end walls of double thickness.

Figure 3:
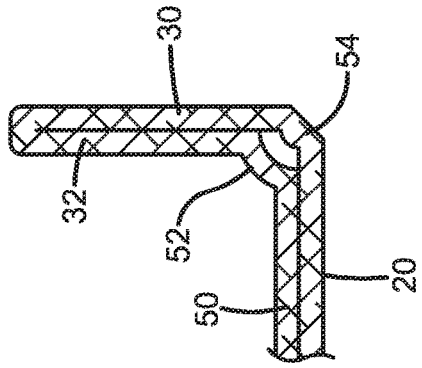
FIG. 3 is a section view taken along line 3-3 of FIG. 2.

FIG. 1 depicts the inner surfaces of the lid panels. The printing that is visible to the user looking at a closed shoe box is added to the other sides of the panels. The disclosure provides a promotional panel 50 that can be printed at the same time and during the same process as the other panels because its printing surface faces the same way and is disposed at the same level as the other panels of lid 10 prior to the assembly of lid 10. Promotional panel 50 has a length and width that are both less than main body panel 20 so that promotional panel can be folded over and glued to the interior surface of main body panel 20. Each dimension can be about one sixteenth or an eighth of an inch smaller. A plurality of integral hinges 52 connect promotional panel 50 to main body panel 20. Hinges 52 are spaced apart and are small compared to the size of panel 50. For example, in an exemplary configuration wherein promotional panel 50 is twelve inches long, each hinge can be about a quarter inch wide (the hinge's width being disposed in the same direction as the length of promotional panel in the exemplary configuration). In the areas where hinges are not located, promotional panel 50 is spaced from main body panel 20. When outer sidewall panel 30 is folded up to a perpendicular position with respect to main body panel 20, the inwardly-disposed layer of paperboard material is pushed inwardly to define a bead 54 as shown in FIG. 3. Hinges 52 span bead 54 and allow panel 50 to lay flat against panel 20. Hinges are also sized to center panel 50 on panel 20.

Figure 2:
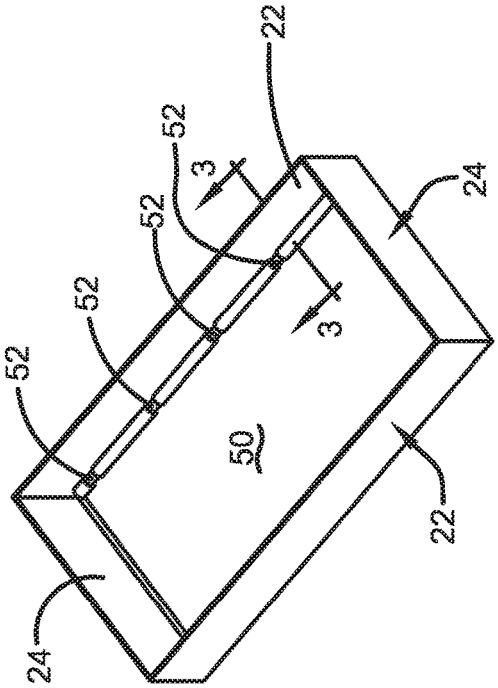
FIG. 2 is a perspective view of a lid with printing on the promotional panel.
Figure 4:
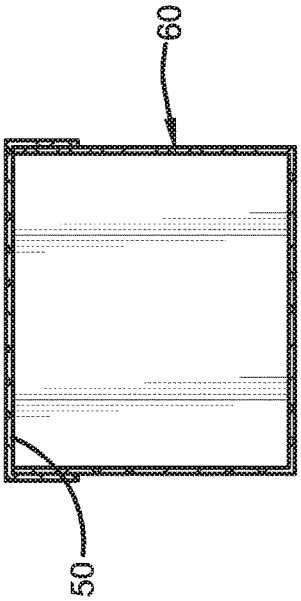
FIG. 4 is a section view of a box with the lid of the disclosure.
Figure 5:
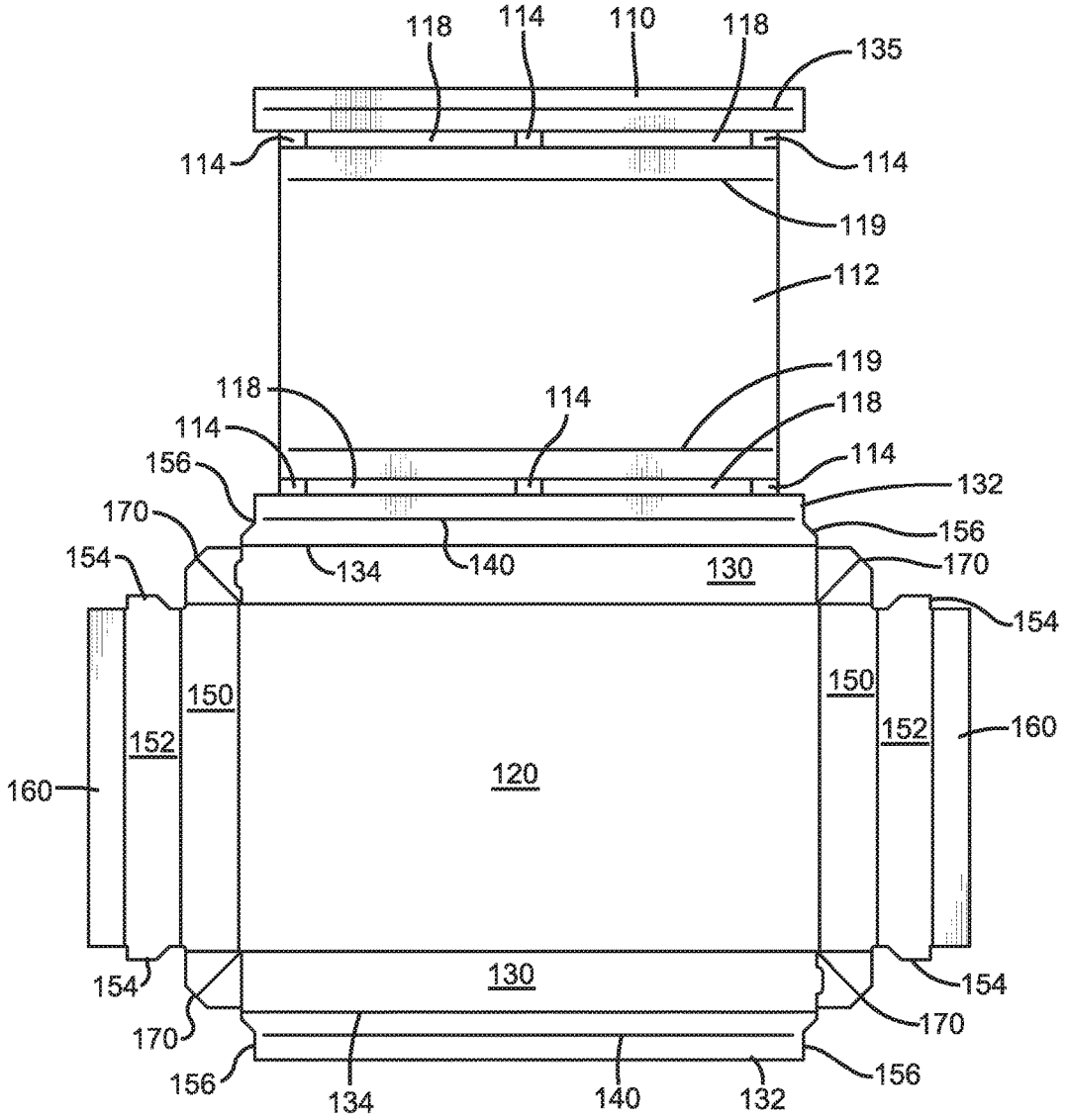
FIG. 5 is a plan view of a blank used to form the exemplary tray of the disclosure.

Panel 50 can thus be printed at the same time and with the same printing process as the other panels. When panel 50 is folded into the position depicted in FIG. 2, the printing is visible to the person who removes lid 10 from its box 60 and looks at the underside of lid 10. The printing can be a simple solid color, a pattern, artwork, a company logo, information about the product or the company, a marketing message, a coupon, instructions, or a combination of these item.

Figure 8:
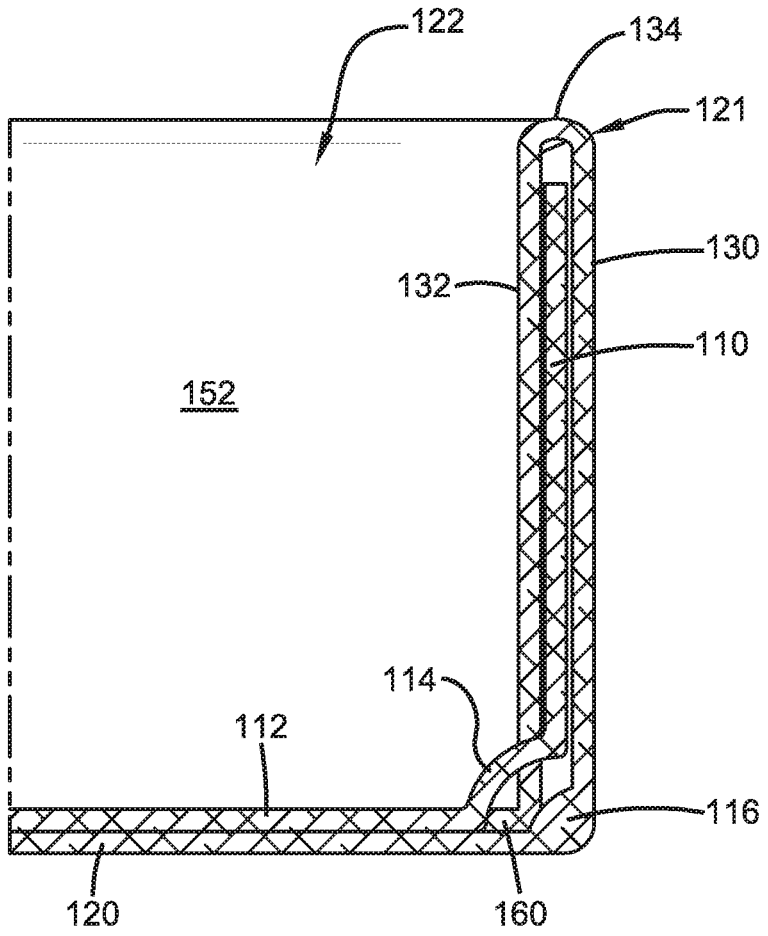
FIG. 8 is a section view taken along line 8-8 of FIG. 7.
Figure 9:
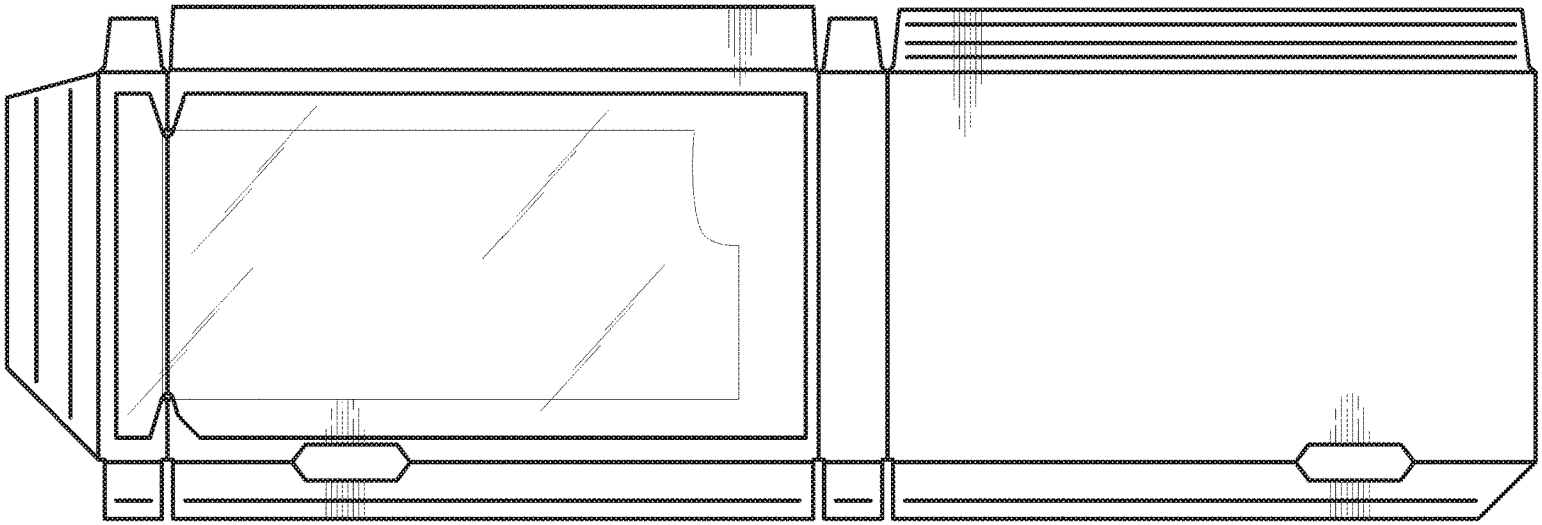
FIG. 9 is a plan view of a blank used to form a sleeve that receives the exemplary tray.
Figure 10:
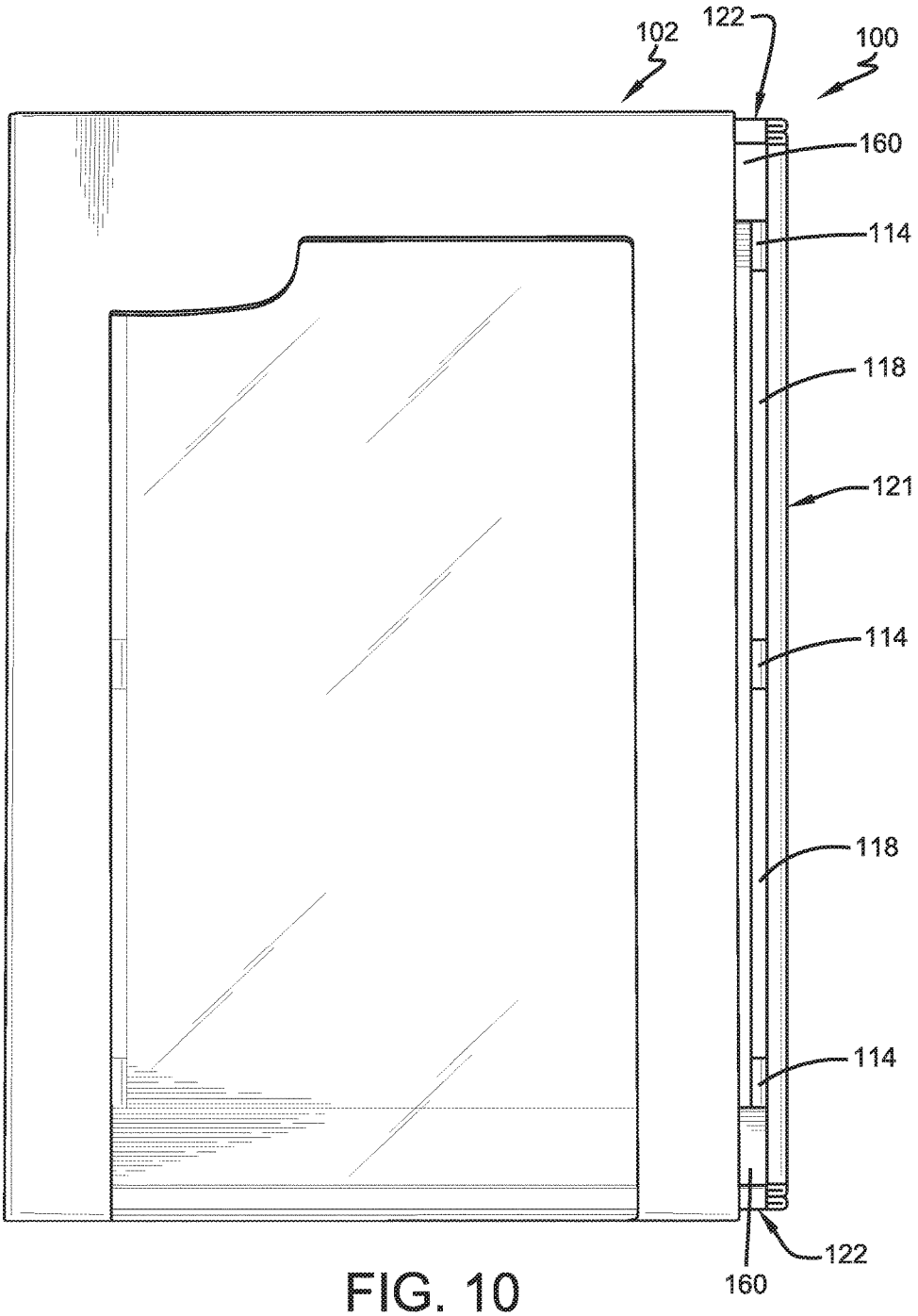
FIG. 10 depicts the tray disposed within the sleeve.
Figure 11:
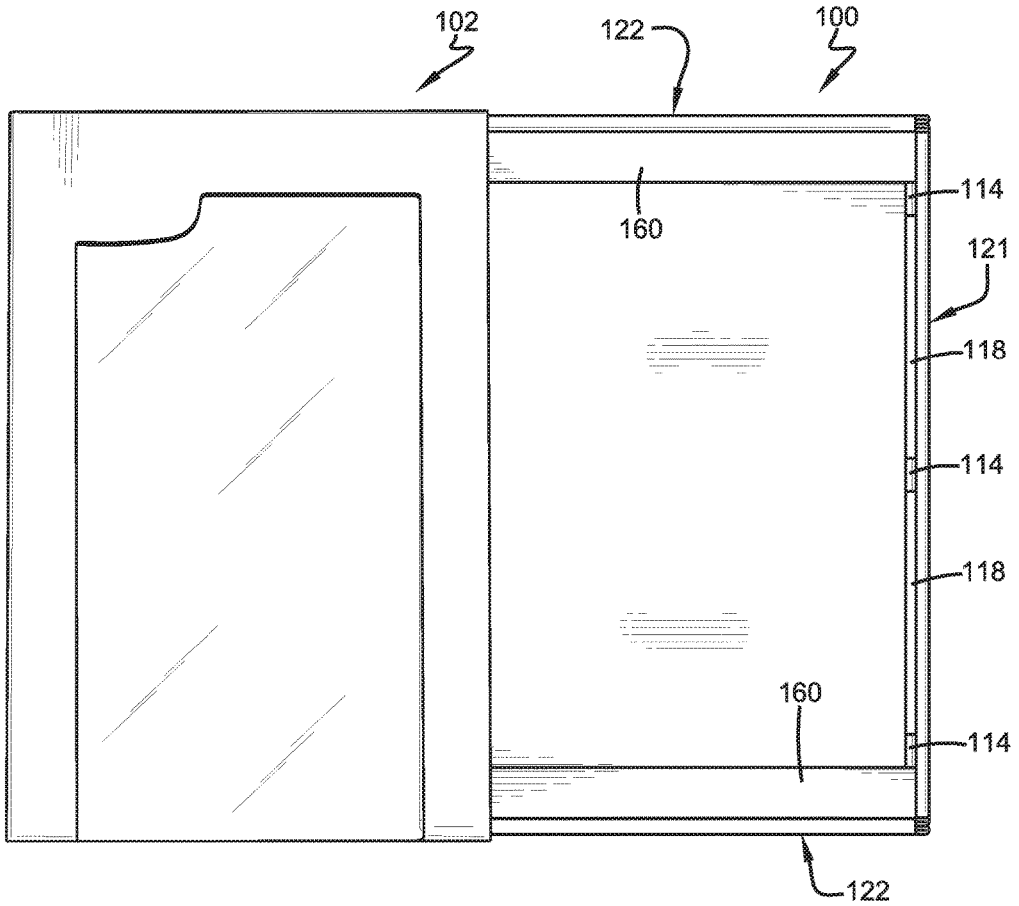
FIG. 11 depicts the tray pulled out of the sleeve in an extended position.

Another exemplary merchandise storage device configuration is a tray which is indicated generally by the numeral 100 in FIGS. 5-11. Tray 100 can be used with a sleeve 102 that receives tray 100 and allows tray 100 to be pulled out of sleeve to view or access the merchandise. The position depicted in FIG. 11 is the extended position. When tray 100 is slid into sleeve 102, it is in the storage position. FIG. 9 depicts a blank that can be folded into sleeve 102. This sleeve includes a window that allows the merchandise carried by tray 100 to be viewed when tray is in the storage position. Tray 100 also can be used alone as a five-sided tray or sized for use with other merchandise packages. Tray 100 also can be used with a lid (removable or hinged) or a wrapped cover instead of sleeve 102. Tray 100 is formed from a flat blank of foldable material. The foldable material can be a paper-based material or a polymer. In the exemplary configuration, the foldable material is a 0.018, 0.020 or 0.024 Solid Bleached Sulphate (SBS) paperboard. In the exemplary configuration, at least one of the lateral walls of tray 100 is reinforced with a reinforcing panel 110 that stiffens the wall and makes it more rigid. The stiffer lateral wall limits bowing and helps the user smoothly slide tray 100 out of sleeve 102.

As above with the example of lid 10, the disclosure provides a promotional panel 112 that can be printed at the same time and during the same process as the other panels because its printing surface faces the same way and is disposed at the same level as the other panels of tray 100 prior to the assembly of tray 100. A plurality of integral hinges 114 connect promotional panel 112 to one of the lateral walls of tray 100. Hinges 114 are spaced apart and are small compared to the size of panel 112. For example, in an exemplary configuration wherein promotional panel 112 is seven inches long, each hinge 114 is about a quarter inch wide (the hinge's width being disposed in the same direction as the length of promotional panel 112 in the exemplary configuration) and three hinges 114 are used. In the areas where hinges 114 are not located, promotional panel 112 is spaced from the lateral wall by gaps 118 of no material. When the outer panel of the lateral wall is folded up to a perpendicular position with respect to the main body panel 120, the inwardly-disposed layer of paperboard material is pushed inwardly to define a bead 116 as shown in FIG. 8. Hinges 114 are disposed over bead 116 and allow panel 112 to lay flat against panel 120. Hinges 114 are also sized to center panel 112 on panel 120.

Panel 112 can thus be printed at the same time and with the same printing process as the other panels. When panel 112 is folded into the position depicted in FIGS. 6-11, the printing is visible to the person who is looking into tray 100 especially after any merchandise is removed. The printing can be a simple solid color, a pattern, artwork, a company logo, information about the product or the company, a marketing message, a coupon, instructions, or a combination of these item.

Promotional panel 112 has a length and width that are both less than main body panel 120 so that promotional panel can be folded over and glued (with adhesive strips 119) to the interior surface of main body panel 120. Each dimension can be about one sixteenth or an eighth of an inch or a quarter inch smaller.

Figure 6:
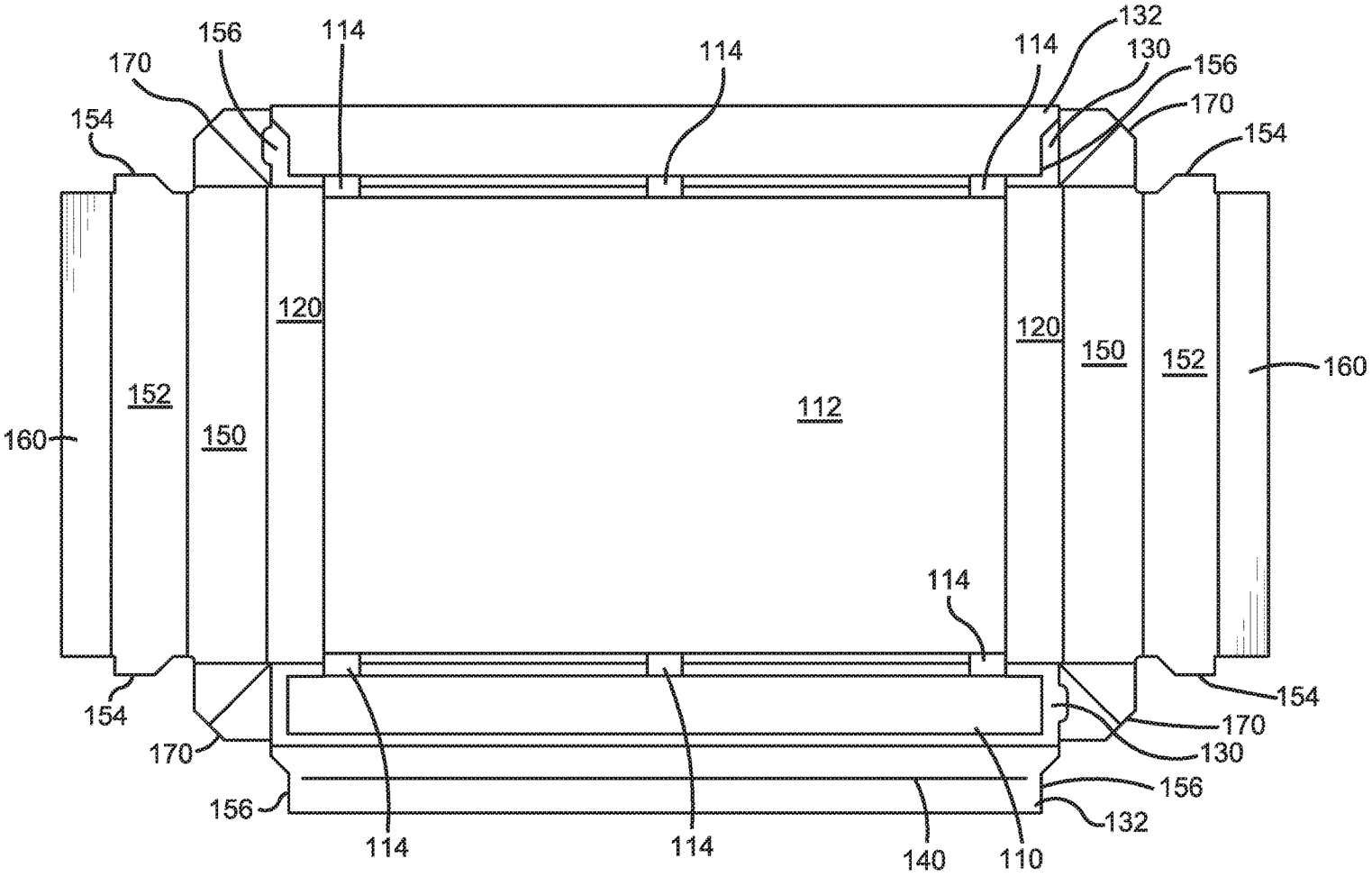
FIG. 6 is a plan view of an intermediate folding step wherein the inner panel of the tray has been folded over the main body panel.
Figure 7:
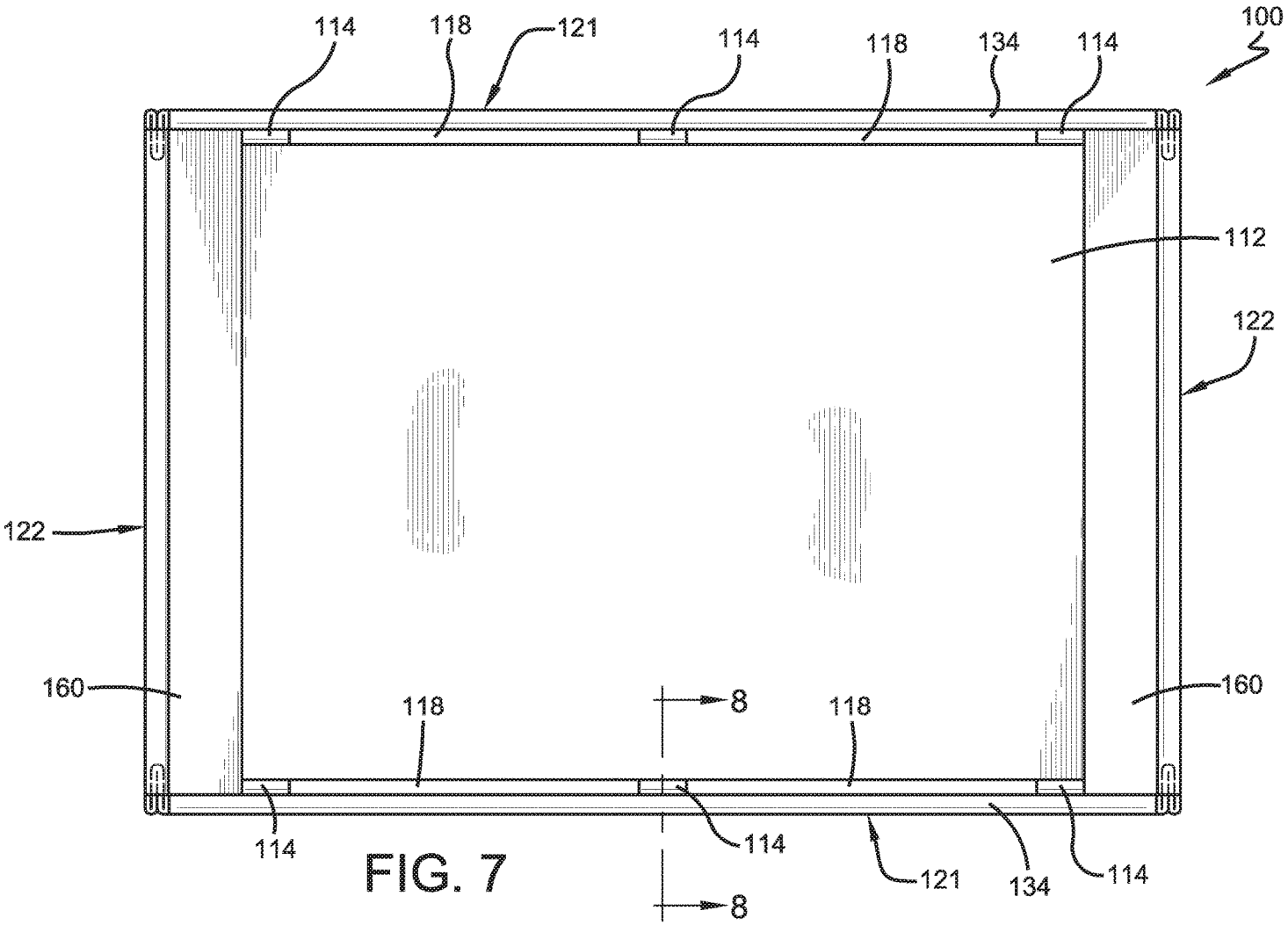
FIG. 7 is a top plan view of the tray.

In this configuration, reinforcing panel 110 is connected to an edge of promotional panel 112 opposite to the edge where promotional panel 112 is connected to the lateral wall of tray 100. Reinforcing panel 110 is connected with a plurality of hinges 114 to space reinforcing panel 110 from promotional panel 112 in the same manner as above. This allows reinforcing panel 110 to be sandwiched into the lateral wall opposite the lateral wall to which promotional panel 112 is connected. When promotional panel 112 is folded over main body panel 120, reinforcing panel 110 is located against the inner surface of the outer panel of the lateral wall as shown in FIG. 6. This panel 110 is then folded inside the lateral wall as shown in FIG. 8 when try 100 is erected.

Tray 100 includes main body panel 120 which also functions as the bottom wall. Tray 100 includes four lateral walls which are provided in this example as a pair of sidewalls 121 and a pair of end walls 122. Each sidewall 121 is formed from an outer panel 130 and an inner panel 132. Outer panel 130 is integrally connected to a lengthwise edge of bottom wall 120 and inner panel 132 is connected to the outer edge of outer panel 130 with a hinge 134 that can be a double hinge that accommodates the thickness of panel 110. The hinges or fold lines can be scores or weakened areas of the material so that the panels readily fold. When reinforcing panel 110 is used, adhesive 135 on one side of panel 110 secures panel 110 to the inner surface of outer panel 130. For one of the lateral walls, a line of adhesive 140 is secures inner panel 132 to reinforcing panel 110. On the other lateral wall, adhesive 140 secures inner 132 panel to outer panel 130.

Each end wall 122 is formed from an outer panel 150 and an inner panel 152. Outer panel 150 is integrally connected to a widthwise edge of bottom wall 120 and inner panel 152 is connected to the outer edge of outer panel 150. The fold lines can be scores or weakened areas of the material so that the panels readily fold. Locking tabs 154 extend from the ends of inner panel 152 and fit into recesses 156 defined by the ends of panels 132 when tray 100 is assembled.

Foot panels 160 are connected to the outer edge of inner panel 152. Foot panels 160 engage bottom wall 220 when tray 100 is assembled. Foot panels 160 can be held in place with adhesive when assembled. Corners 170 fold against inner panels 152 or 132. The fold lines on corners 170 and that separate foot panels 160 from panels 152 are perforations that provide easy folding.

Figure 12:
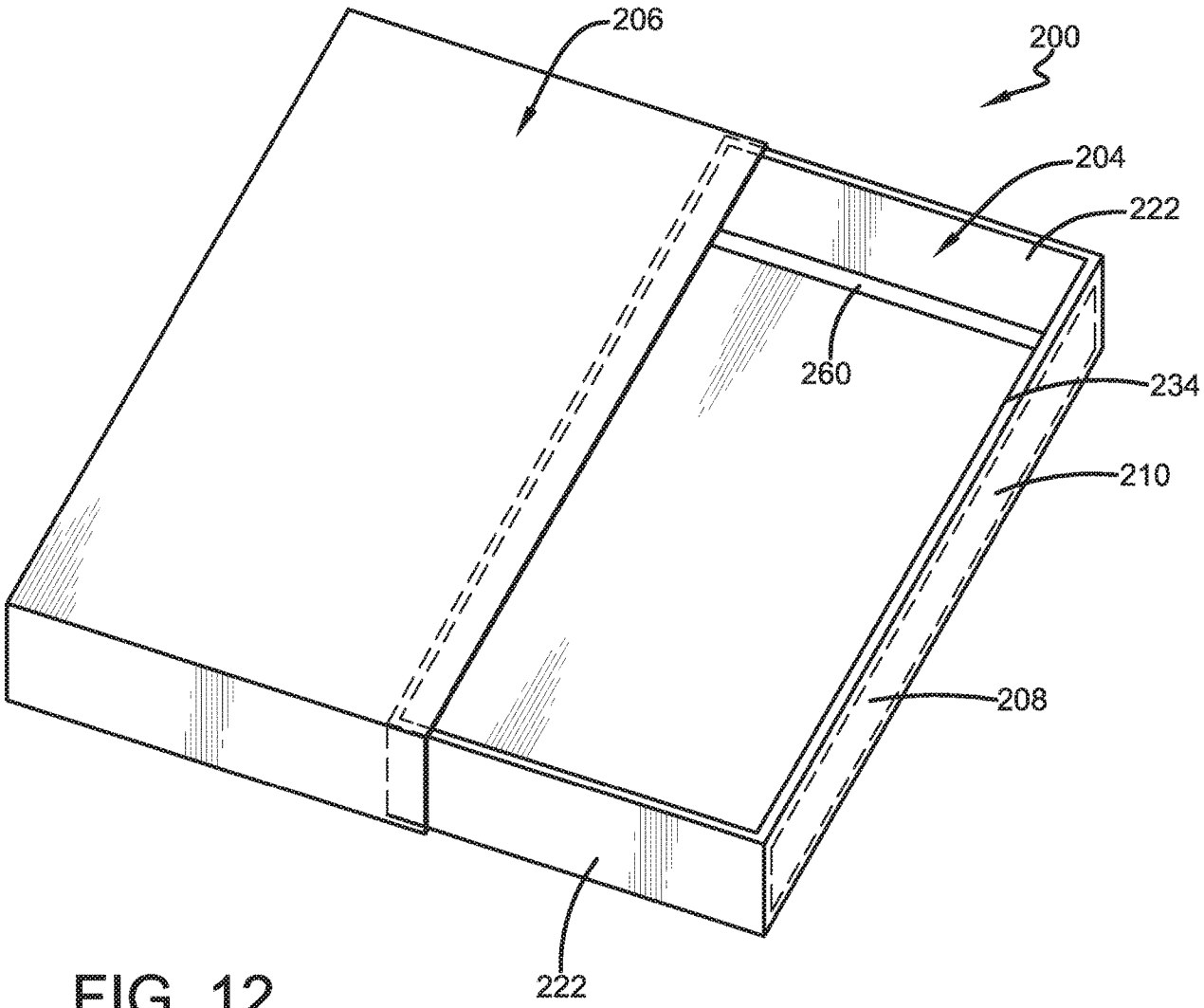
FIG. 12 is a perspective view of an exemplary tray extended from an outer sleeve.

Another exemplary container assembly is indicated in FIG. 12 by the numeral 200 and includes a tray 204 and an outer sleeve 206. Outer sleeve 206 is in the form of a five-sided sleeve with an opening. Sleeve 206 can include a locking or stopping member that prevents tray 204 from being readily pulled out of sleeve 206 by engaging a portion of tray 204 just before it is separated from sleeve 206. Tray 204 is slid in and out of sleeve 206. The position depicted in FIG. 12 is the extended position. When tray 204 is slid into sleeve 206, it is in the storage position. In this position, the outer lateral wall 208 which in this example is a sidewall of tray 204 substantially closes the opening of sleeve 206. Sleeve 206 can define a cutout above its opening that allows the user to grasp outer sidewall 208. In the exemplary configuration depicted in FIG. 12, at least the outer sidewall 208 of tray 204 includes a reinforcing member 210 that stiffens the sidewall and makes it more rigid. The stiffer outer wall limits bowing and helps the user smoothly slide tray 204 out of sleeve 206.

Tray 204 also can be used with a lid (removable or hinged) or a wrapped cover instead of sleeve 206.

Figure 13:
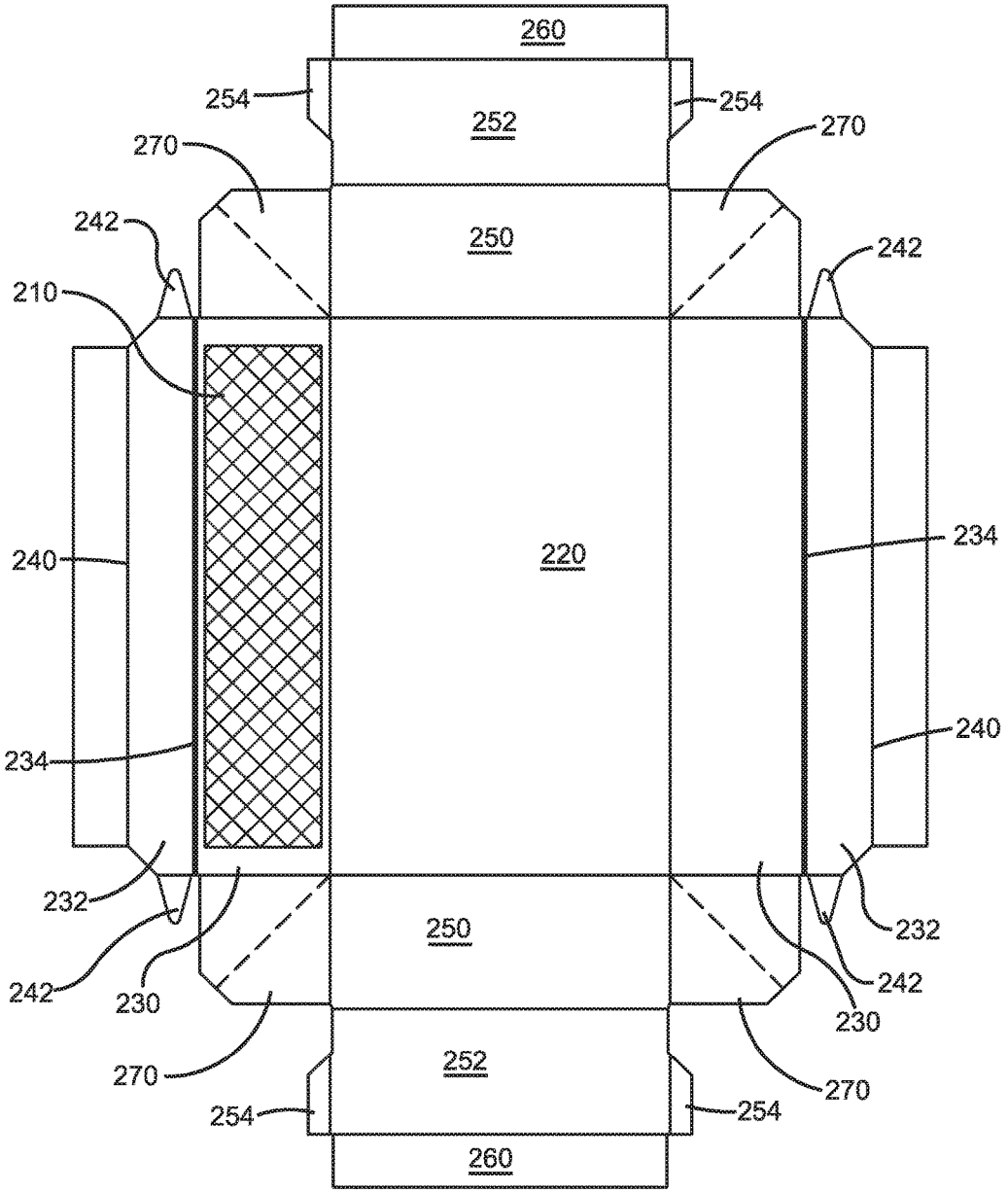
FIG. 13 is a plan view of a blank for another configuration of a tray having the reinforcing member in one of its sidewalls.
Figure 14:
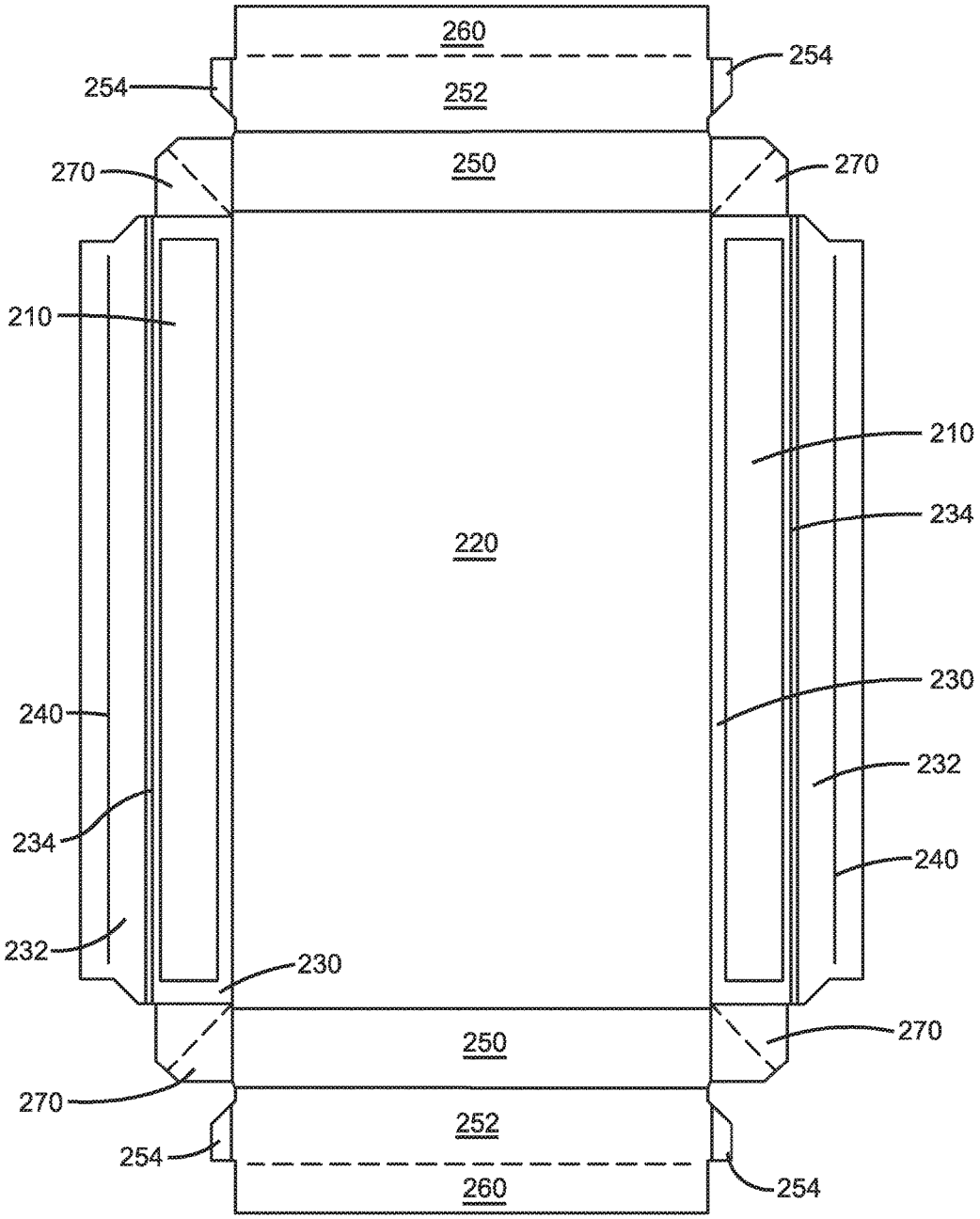
FIG. 14 is a plan view of a blank for another configuration of a tray having the reinforcing member in one of its sidewalls.

In the configuration of FIGS. 12-14, reinforcing member 210 is of various types of materials such as: plastic, corrugated, Coroplast®, steel, chip board or basically any other material that functions to stiffen a wall when added as a substrate. Member 210 can be provided as a single unit or as a plurality of members. The thickness and stiffness of the reinforcing member can be adjusted to provide the level of stiffness desired by the user or for the end-use application. Thicknesses of ⅛ inch to 1/16 inch to 1/32 inch will function with paper-based or polymer-based members. In the exemplary configuration, reinforcing member 210 is 0.042 CHIP or 0.040 HIPS. The cross hatching in FIG. 13 represents adhesive on one or both sides of reinforcing member 210.

Each tray 204 includes a bottom wall 220 and a plurality of lateral walls which are provided in the examples as a pair of sidewalls 208 and a pair of end walls 222. These are made from paperboard (0.018, 0.020 or 0.024 solid bleached board (SBS) for example). Each sidewall 208 is formed from an outer panel 230 and an inner panel 232. Outer panel 230 is integrally connected to a lengthwise edge of bottom wall 220 and inner panel 232 is connected to the outer edge of outer panel 230 with a double hinge 234 that accommodates the thickness of member 210 and the adhesive used to secure member 210 in place. The fold lines can be scores or weakened areas of the material so that the panels readily fold. When reinforcing member 210 is used, adhesive on both sides of member 210 secure inner panel 232 to outer panel 230. When member 210 is not disposed between panels 230 and 232, a line of adhesive 240 is used to secure the panels together. Locking tabs 242 extend from the ends of inner panel 232 and are secured to end walls 222 when tray 204 is assembled.

Each end wall 222 is formed from an outer panel 250 and an inner panel 252. Outer panel 250 is integrally connected to a widthwise edge of bottom wall 220 and inner panel 252 is connected to the outer edge of outer panel 250. The fold lines can be scores or weakened areas of the material so that the panels readily fold. When reinforcing member 210 is used with end walls 222, adhesive on both sides of member 210 secure inner panel 252 to outer panel 250. When member 210 is not disposed between panels 250 and 252, an optional line of adhesive can be used to secure the panels together. Locking tabs 254 extend from the ends of inner panel 252 and are secured to sidewalls 208 when tray 204 is assembled.

Foot panels 260 are connected to the outer edge of inner panel 252. Foot panels 260 engage bottom wall 220 when tray 204 is assembled. Foot panels 260 can be held in place with adhesive when assembled. Corners 270 fold against inner panels 252 or 232. The fold lines on corners 270 and that separate foot panels 260 from panels 252 are perforations that provide easy folding.

Figure 15:
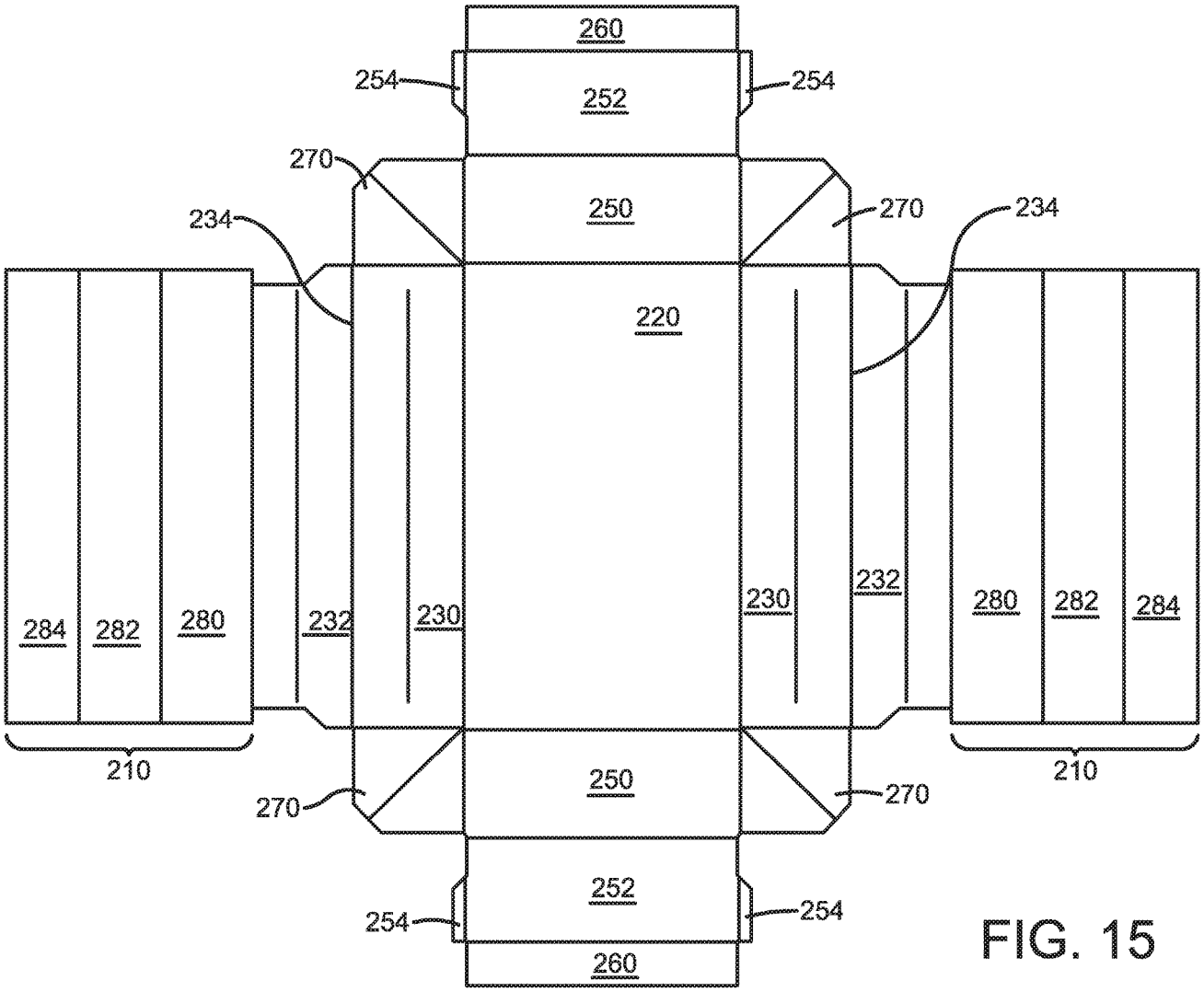
FIG. 15 is a plan view of a blank for another configuration of a tray having the reinforcing member in two of its sidewalls.

FIG. 15 depicts a configuration wherein reinforcing member 210 can be folded into one of the walls of tray 204 from a plurality of integral panels. In the example, both sidewalls have reinforcing members 210 made from three reinforcing member panels 280, 282, and 284 that fold between panels 230 and 232 to define reinforcing member 210. Outermost reinforcing member panel 284 folds with a reverse fold. Panels 280, 282, and 284 can be secured together with adhesive and then secured inside panels 230 and 232 with adhesive.

Reinforcing member 210 can be used with any sidewall 208 or any end wall 222. When reinforcing member 210 is placed in a wall, the hinge that connects the panels can be formed as a double hinge 234.

The foregoing description has been made with reference to exemplary embodiments. Modifications and alterations of those embodiments will be apparent to one who reads and understands this general description. The present disclosure should be construed as including all such modifications and alterations insofar as they come within the scope of the appended claims or equivalents thereof.

The relevant portion(s) of any specifically referenced patent and/or published patent application is/are incorporated herein by reference.

The invention claimed is:

1. A merchandise storage container device, comprising:

a main body panel having an outer surface and an inner surface;

first and second lateral walls connected to the main body panel;

a promotional panel having an outer surface and an inner surface; the inner surface of the promotional panel facing the inner surface of the main body panel;

a plurality of spaced hinges directly connecting a first edge of the promotional panel to the first lateral wall;

the first lateral wall including an outer panel and an inner panel; the outer panel of the first lateral wall defining an inwardly-projecting bead at a fold line between the outer panel of the first lateral wall and the main body panel;

each of the hinges having a portion disposed over the inwardly-projecting bead;

the promotional panel being spaced from the inner panel of the first lateral wall; and a reinforcing panel connected to another edge of the promotional panel; the reinforcing panel connected to the second lateral wall.

2. The device of claim 1, wherein the promotional panel is centered with respect to the main body panel.

3. The device of claim 1, wherein the main body panel, the first and second lateral walls, and the promotional panel are integrally formed from a foldable material.

4. The device of claim 3, wherein the foldable material is a paperboard.

5. The device of claim 4, wherein the paperboard is a solid bleached sulphate paperboard.

6. The device of claim 1, wherein the inner surface of the promotional panel is connected to the inner surface of the main body panel with an adhesive.

7. The device of claim 6, wherein the main body panel has a length and a width and the promotional panel has a length and a width; the length of the promotional panel being less than the length of the main body panel and the width of the promotional panel being less than the width of the main body panel.

8. The device of claim 1 wherein each lateral wall is formed from an outer panel and an inner panel that is connected to outer sidewall panel with a fold.

9. The device of claim 8, wherein the inner panel is adhered to the outer panel to form a lateral wall of double thickness.

10. The device of claim 9, wherein the inner panel has an end with each of the hinges extending from the end of the inner panel.

11. The device of claim 1, wherein the reinforcing panel is connected to the promotional panel with a plurality of hinges.

12. The device of claim 11, wherein the reinforcing panel is spaced from the promotional panel by gaps.

13. The device of claim 1, wherein the second lateral wall includes an outer panel and an inner panel; the reinforcing panel disposed between the inner panel of the second lateral wall and the outer panel of the second lateral wall.

14. A merchandise storage container device, comprising:

a main body panel having an outer surface and an inner surface;

first and second lateral walls connected to the main body panel;

a promotional panel having an outer surface and an inner surface; the inner surface of the promotional panel facing the inner surface of the main body panel;

a plurality of spaced hinges directly connecting a first edge of the promotional panel to the first lateral wall; and a reinforcing panel connected to another edge of the promotional panel; the reinforcing panel connected to the second lateral wall.

15. The device of claim 14, wherein each of the lateral walls includes an outer panel and an inner panel; the outer panel of each lateral wall defining an inwardly-projecting bead at a fold line between the outer panel and the main body panel; and each of the hinges having a portion disposed over the inwardly-projecting bead.

16. The device of claim 15, wherein the promotional panel is spaced from the inner panel of the first lateral wall.

17. The device of claim 14, wherein the second lateral wall includes an inner panel and an outer panel; the reinforcing panel disposed between the inner and outer panels of the second lateral wall.

18. The device of claim 17, further comprising a plurality of hinges connecting the reinforcing panel to the promotional panel.

* * * * *